US007252690B2

(12) United States Patent
Barbour et al.

(10) Patent No.: US 7,252,690 B2
(45) Date of Patent: Aug. 7, 2007

(54) FUEL COMPOSITION

(75) Inventors: Robert Howie Barbour, Ashbourne (GB); David John Rickeard, Didcot (GB); Alan Mark Schilowitz, Highland Park, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/148,815

(22) PCT Filed: Dec. 14, 2000

(86) PCT No.: PCT/EP00/12755

§ 371 (c)(1),
(2), (4) Date: Sep. 27, 2002

(87) PCT Pub. No.: WO01/44415

PCT Pub. Date: Jun. 21, 2001

(65) Prior Publication Data

US 2003/0154648 A1 Aug. 21, 2003

(30) Foreign Application Priority Data

Dec. 16, 1999 (GB) ..... 9929803.6

(51) Int. Cl.
*C10L 1/22* (2006.01)

(52) U.S. Cl. ..... 44/329; 44/333; 44/342

(58) Field of Classification Search ..... 44/329, 44/429, 430, 333, 342
See application file for complete search history.

(56) References Cited

U.S. PATENT DOCUMENTS

| | | | | |
|---|---|---|---|---|
| 2,754,216 | A * | 7/1956 | Chenicek | 426/545 |
| 2,771,367 | A * | 11/1956 | Thompson et al. | 426/544 |
| 4,266,947 | A * | 5/1981 | Hartle et al. | 44/327 |
| 4,773,916 | A * | 9/1988 | Croudace et al. | 44/440 |
| 5,516,443 | A * | 5/1996 | Jackson et al. | 508/515 |
| 5,730,762 | A * | 3/1998 | Murakami et al. | 44/329 |
| 6,656,237 | B1 | 12/2003 | Barbour et al. | 44/429 |

FOREIGN PATENT DOCUMENTS

EP 874039 A1 * 10/1998

* cited by examiner

*Primary Examiner*—Cephia D. Toomer
(74) *Attorney, Agent, or Firm*—Joseph J. Allocca

(57) ABSTRACT

This invention is a fuel composition having a sulphur content of ≦50 ppm by weight and comprising ≧50 ppm by weight of at least one fused polycyclic aromatic compound which has at least one hetero-atom selected from O and N either (a) as a heterocyclic group, or, (b) as an exocyclic group in which the hetero-atom is attached either directly or through one other carbon atom to a ring carbon atom wherein the fused polycyclic aromatic compound is substituted on at least one of its ring carbon atoms by a C1-C4 alkyl group. These compounds are capable of improving the antiwear and lubricity properties of a low sulphur fuels, especially diesel fuels, when compared with the performance of the same fuel in the absence of such compounds.

14 Claims, No Drawings

FUEL COMPOSITION

This invention relates to fuel compositions of low sulphur content which contain at least one component capable of enhancing the lubricity of such low sulphur fuels.

Fuels such as diesel are widely used in automotive transport due to their low cost. However, one of the problems with such fuels is the presence of relatively high concentrations of sulphur containing compounds. Excessive sulphur contributes to exhaust particulate emissions and can also degrade the effectiveness of some exhaust after-treatment technology which is being introduced in response to regulated limits on exhaust emissions. As a result, the permitted level of sulphur in diesel fuel has been progressively reduced over the years and further reductions are planned for the future. Whilst a reduction in sulphur content can be readily achieved by well known processes such as hydrodesulphurisation which is generally carried out in the presence of a catalyst, such processes also adversely affect the lubricity of the resultant desulphurised product. Consequently, it is necessary to formulate compositions which are low in sulphur content but are also of the desired lubricity in order to minimise wear and friction when used in automotive engines and to minimise the damage to the injection system of a diesel engine. It has hitherto been the practice to add anti-wear agents to such fuel formulations including fatty acids, fatty acid esters, lactones, polyoxyalkylene ethers, amino compounds and their like for this purpose. All such compounds are surfactant in nature by virtue of having a hydrophobic 'tail' and hydrophilic 'head group'. A publication by Wei and Spikes titled 'The lubricity of diesel fuels' (published in Wear, 111 (1986)217) discloses that heterocyclic nitrogen compounds, like quinoline and indole, also have a beneficial effect on the antiwear performance of base fuels. Although these compounds do not have a surfactant like structure they are of the same general structure as the natural compounds that are destroyed during hydrotreatment.

A further article by D. Wei et al in Lubrication Science, 1989, 2(1), pp 63-67 entitled "The Influence of Chemical Structure of Certain Nitrogen-Containing Organic Compounds on Their Antiwear Effectiveness: The Critical Role of Hydroxy Group" goes on to show that hydroxy groups involved in some nitrogen-containing compounds have been found to improve their antiwear performance significantly and states that hydroxy substituted benzothiazoles are most effective in wear reduction and anti-scuffing. With this in view the author reports the results of the tests carried out on films formed on rubbing surfaces by the benzo-derivatives of pyridine and thiazole, with or without hydroxy groups on the rings. The article concludes that protective films formed on rubbing surfaces by the above heterocyclic compounds bearing a hydroxy group are significantly different from those produced by their analogues with similar chemical composition and physical properties.

It has also been found that some polycyclic aromatic compounds such as eg carbazoles have limited solubility in the fuel to function efficiently (Wei et al, Journal of Petroleum (Petroleum Processing) Vol 4, No 1, p90, March 1988). Thus, EP-A-757092 describes the use of alkyl carbazoles, e.g. methyl and ethyl carbazole, where the alkyl group was attached to the hetero-atom itself.

It has now been found that the presence of alkyl substituents attached to or in close proximity to the hetero-atom may mask the lubricity enhancing or anti-wear potency of the hetero-atom in these compounds possibly due to steric hindrance. This, in turn, reduces the interaction of the hetero-atom and the metal surface which is essential for adsorption and the formation of a protective layer. It has also been found that such steric effects may be mitigated without detracting from the solubilising effects of the substituent alkyl groups by distancing the alkyl group(s) from the hetero-atom.

The present invention, therefore, provides a fuel composition having a sulphur content of not more than 50 ppm by weight and comprising at least 50 ppm based on the total weight of the fuel composition of at least one fused polycyclic aromatic compound which comprises at least one hetero-atom selected from oxygen and nitrogen either a. as a heterocyclic group, or, b. as an exocyclic group in which at least one of the hetero-atoms is attached either directly or through one other carbon atom to a ring carbon atom of the fused polycyclic aromatic compound wherein the fused polycyclic aromatic compound is substituted on at least one of its ring carbon atoms by a C1-C4 alkyl group such that in the case of i. the heterocyclic group, the alkyl substituent is on a ring carbon atom other than the carbon atom which is in the $\alpha$-position with respect to at least one of the hetero-atoms provided that where the $\alpha$-carbon atom is a bridging carbon atom of a fused polycyclic aromatic compound, it is other than the $\beta$-carbon atom with respect to said hetero-atom in the ring, and ii. an exocyclic group, the alkyl substituent is on a ring carbon atom which is neither in the $\alpha$-position nor in the $\beta$-position with respect to the exocyclic hetero-atom.

As described above, the sulphur content of the fuel composition is suitably less than 50 ppm by weight and is preferably less than 40 ppm by weight. Such low sulphur levels can be achieved in a number of ways. For instance, this may be achieved by well known methods such as eg, catalytic hydrodesulphurisation. Typically, the present invention is applicable to a broad range of petroleum fuels from the light boiling gasoline (which typically boils between 50 and 200° C.) to distillate fuel (which typically boils between 150 and 400° C.). The most common distillate fuels are kerosene, jet fuels, diesel fuels and heating oils. The lubricity properties of ultra-low sulphur (50 ppm or less) base fuels with a $T_{95}$ of suitably $\leqq$340° C., preferably $\leqq$320° C., particularly benefit from the presence of polycyclic aromatic compounds comprising at least one hetero-atom, especially with nitrogen s the hetero-atom, referred to above. Especially, the lubricity properties are more of an issue with diesel fuels because diesel fuel injection pumps are more sensitive to wear problems. The base fuels may comprise mixtures of saturated, olefinic and aromatic hydrocarbons and these can be derived from straight run streams, thermally or catalytically cracked hydrocarbon feedstocks, hydrocracked petroleum fractions, catalytically reformed hydrocarbons, or synthetically produced hydrocarbon mixtures. The present invention is particularly applicable to diesel fuels that have recently been introduced into the UK market and are generally referred to as ultra-low sulphur automotive diesel oils (hereafter "ULSADO" and is sampled eg from Esso's Fawley Refinery).

The fused polycyclic aromatic compound comprises at least one hetero-atom selected from oxygen and nitrogen either a. as a heterocyclic group,or, c. as an exocyclic group in which the hetero-atom is attached either directly or through one other carbon atom to a ring carbon atom of the fused polycyclic aromatic compound wherein the fused polycyclic aromatic compound is substituted on at least one of its ring carbon atoms by a C1-C4 alkyl group such that in the case of i. the heterocyclic group, the alkyl substituent is on a ring carbon atom other than the carbon atom which is in the α-position with respect to the heteroatom provided that where the α-carbon atom is a bridging carbon atom of a fused polycyclic aromatic compound, it is other than the β-carbon atom with respect to the hetero atom in the ring, and ii. an exocyclic group, the alkyl substituent is on a ring carbon atom which is neither in the α-position nor in the β-position with respect to the exocyclic hetero-atom.

By the expression "fused polycyclic aromatic compound" as used herein and throughout the specification is meant that said compound comprises an aromatic moiety which has at least two fused rings of which at least one is an aromatic ring, which aromatic ring may in turn be a heterocyclic ring, whether or not the remaining ring(s) in the fused polycyclic structure are aromatic. Where the fused polycyclic aromatic compound contains a heterocyclic ring, the hetero-atom is nitrogen or oxygen. These fused polycyclic aromatic compounds may contain more than one heterocyclic atom. One such example of a fused polycyclic aromatic/heterocyclic ring is benzimidazole.

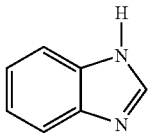

Benzimidazole

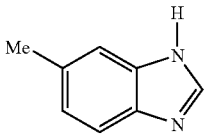

5-Methyl benzimidazole

In this compound, if a C1-C4 alkyl group is substituted in a non-α-position, such a compound would be 5-alkylbenzimidazole and more specifically eg 5-methyl benzimidazole.

Where the exocyclic group contains nitrogen as the hetero-atom, it is suitably a primary amino group. Examples of such compounds which have an exocyclic group containing nitrogen wherein the nitrogen is directly attached to a ring carbon atom include inter alia 6-ethyl-2,3-diamino naphthalene and 4-amino quinaldine.

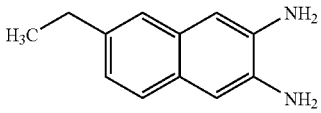

6-Ethyl-2,3-diamino naphthalene

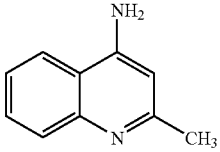

4-Amino quinaldine

Where the exocyclic group contains oxygen as the hetero-atom, it is suitably an alcohol or a carboxylic acid group. It is essential that the polarity of these groups are maintained by retaining the hydrogen in these groups such as eg —OH or —C(O)OH by not converting the alcohol into an ether or an ester group and similarly not converting the carboxylic acid group into an ester group. As explained above, in the case of the —OH group, the alkyl substituent should not be in the α-position or in the β-position with respect to the exocyclic oxygen-atom in order to maximise the potency of the hetero-atom for imparting lubricity and anti-wear properties to the fuel composition. Similarly, in the case of the carboxylic acid group, the alkyl substituent should neither be in the α-position nor in the β-position with respect to the exocyclic oxygen-atom. In fact, in the case of the carboxyl group, it is preferable that the alkyl substituent is even further removed from the hetero-atom eg by keeping vacant even the γ-position with respect to the oxygen atom, if the carbon of the carboxyl group is considered as the α-carbon atom. Examples of such compounds include inter alia 6-methyl naphth-2-ol and 4-methyl-2-naphthoic acid.

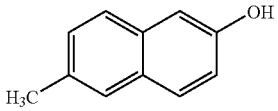

6-Methyl naphth-2-ol

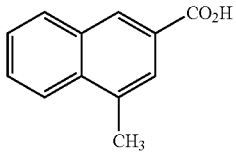

4-Methyl-2-naphthoic acid

As mentioned previously, the polycyclic aromatic compounds can contain >1 hetero-atom, and while it is preferable that both be unhindered, it is possible that one hetero-atom is unhindered while the second has an alkyl substituent in close proximity. Examples of such compounds are 2-hydroxy-4-methyl quinoline and 8-hydroxy quinaldine.

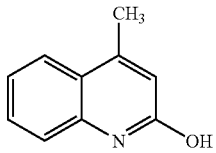

2-hydroxy-4-methyl quinoline

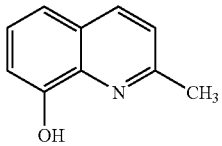

8-hydroxy quinaldine

In this context it is worth noting that the composition according to the present invention has enhanced lubricity when compared with fuel compositions which have a low sulphur content but which do not contain a fused polycyclic aromatic compound containing nitrogen or oxygen as the heteroatom and which do not carry an alkyl substituent as described above. The amount of the fused polycyclic aromatic compound as described above added to the fuel composition is at least 50 ppm, suitably 50-2000 ppm and is preferably from 50-500 ppm by weight of the total fuel composition. In this context it will be understood by those skilled in the art that the improvement in antiwear and lubricity characteristics of the fuel composition may not bear a linear relationship commensurate with the amount of the fused polycyclic aromatic compound that is added to said composition. Thus, addition of a vast excess of such an additive may not necessarily continually improve the antiwear or lubricity properties of the fuel composition.

The antiwear and lubricity performance of the fuel compositions of the present invention were measured according to the so-called high frequency reciprocating rig test (hereafter referred to as "HFRR"). The HFRR test consists of a loaded upper ball 6 mm in diameter, which oscillates against a static lower plate. Both friction and contact resistance are monitored throughout the test. The tests are conducted according to the standard procedure published as CEC F-06-A-96 in which a load of 2N (200 g) was applied, the stroke length was 1 mm, the reciprocating frequency was 50 Hz and sample temperature of 60° C. The ambient temperature and humidity were controlled within the specified limits and the calculated value of wear scar diameter was corrected to the standardized water vapour pressure of 1.4 kPa. The specimen ball was a grade 28 (ANSIB3.12), AISI E-52100 steel with a Rockwell hardness "C" scale (HRC) number of 58-66 (ISO 6508), and a surface finish of less than 0.05 μm $R_a$, and the lower plate was AISI E-52000 steel machined from annealed rod, with a Vickers hardness "HV30" scale-number of 190-210 (ISO 6507/1). It is turned, lapped and polished to a surface finish of 0.02 μm $R_a$.

Summary of HFRR Test Conditions

| | | | |
|---|---|---|---|
| Fluid volume, ml | 2.0 ± 0.20 | Specimen steel | AISI E-52100 |
| Fluid temperature, ° C. | 60 ± 2 | Ball diameter, mm | 6.00 |
| Bath surface area, $cm^2$ | 6.0 ± 1.0 | Surface finish (ball) | <0.05 μm Ra |
| Stroke length, mm | 1.0 ± 0.02 | Hardness (ball) | 58 - 66 Rockwell C |
| Frequency, Hz | 50 ± 1 | Surface finish (plate) | <0.02 μm Ra |
| Applied load, g | 200 ± 1 | Hardness (plate) | 190 - 210 HV 30 |
| Test duration, minutes | 75 ± 0.1 | Ambient conditions | See text |

The present invention is further illustrated with reference to the following Examples. The ULSADOs (<50 ppm sulphur) used in this study are described below in Table 1:

TABLE 1

| Analysis | ULSADO |
|---|---|
| Density @ 15° C. | 834.0 |
| Viscosity $KV_{40}$ | 2.52 |
| Sulphur content (ppm) | 27 |
| Nitrogen content (ppm) | 27 |
| Aromatics (% m/m) | |
| 1-ring | 20.55 |
| 2-ring | 7.77 |
| 3-ring | 0.68 |
| Distillation | |
| IBPt | 157 |
| T5% | 181 |
| T10% | 196 |
| T20% | 222 |
| T30% | 246 |
| T40% | 264 |
| T50% | 276 |
| T60% | 286 |
| T70% | 293 |
| T80% | 301 |
| T90% | 310 |
| T95% | 318 |
| FBPt | 331 |

The following compounds shown in Table 2 below were tested at the specified concentrations:

A series of benzimidazole derivatives (1), (2) and (3) have been evaluated to show that the presence of alkyl groups improves solubility but these groups need to be in a remote position so as not to adversely affect the lubricity performance.

All three compounds were added to reference ULSADO (the base fuel) at 50 ppm and 150-ppm levels and left under ambient conditions for about 1 week. After this time undissolved solids were observed in all six samples (low and high treats). All samples were then sonicated and observed on a regular basis. The lower treat rate samples dissolved before the higher treat rate samples and 5-methyl benzimidazole (compound 2) dissolved the quickest followed by compound 3 and finally compound 1.

TABLE 2

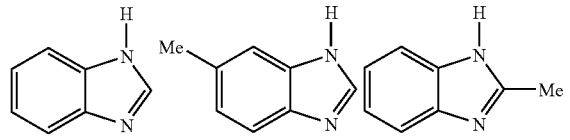

| No Compound | (1) Benzimidazole | (2) 5-methyl benzimidazole | (3) 2-methyl benzimidazole |
|---|---|---|---|
| Solubility | Worst | Best | 2nd |
| HFRR @ 50 ppm | 522 μm | 389 μm Best | 574 μm |

TABLE 2-continued

| No Compound | (1) Benzimidazole | (2) 5-methyl benzimidazole | (3) 2-methyl benzimidazole |
|---|---|---|---|
| HFRR @ 150 ppm | 273 μm | 257 μm Best | 320 μm Worst |

HFRR results for all samples tested showed 5-methyl benzimidazole (compound 2) (according to the invention) to be the most active followed by compound 1 and then 3. Under the same test conditions, the base fuel gave a wear scar of 556 μm.

Thus, the compound with remote alkyl substitution was the most soluble and had the best lubricity performance.

The invention claimed is:

1. A method for improving the antiwear and lubricity properties of a low sulphur fuel having a sulphur content of not more than 50 ppm by weight by adding to the fuel at least 50 ppm based on the total weight of the fuel of at least one fused polycyclic aromatic compound wherein the fused polycyclic aromatic compound added to the fuel is selected from the group consisting of 5-methyl benzimidazole, 2-hydroxy-4-methyl quinoline and 8-hydroxy quinaldine.

2. The method of claim 1 wherein the fused polycyclic aromatic compound added to the fuel is selected from the group consisting of 2-hydroxy-4-methyl quinoline and 8-hydroxy quinaldine.

3. The method of claim 1 wherein the fused polycyclic aromatic compound is added to the fuel in an amount in the range of 50 to 2000 ppm by weight of the total fuel composition.

4. The method of claim 1 wherein the fused polycyclic aromatic compound added to the fuel is 5-methyl benzimidazole.

5. The method of claim 2 or 4 wherein the fused polycyclic aromatic compound is added to the fuel in an amount in the range of 50 to 2000 ppm by weight of the total fuel composition.

6. The method of claim 1 wherein the fuel is a diesel fuel.

7. The method of claim 2 or 4 wherein the fuel is a diesel fuel.

8. A low sulphur fuel composition containing a base fuel and at least one of an antiwear and/or lubricity enhancing additive which comprises a fused polycyclic aromatic compound wherein the fused polycyclic aromatic compound added to the fuel is selected from the group consisting of 5-methyl benzimidazole, 2-hydroxy-4-methyl quinoline and 8-hydroxy quinaldine.

9. The low sulphur fuel composition of claim 8 wherein the fused polycyclic aromatic compound is 5-methyl benzimidazole.

10. The low sulphur fuel composition of claim 8 wherein the fused polycyclic aromatic compound is 2-hydroxy-4-methyl quinoline.

11. The low sulphur fuel composition of claim 8 wherein the fused polycyclic aromatic compound is 8-hydroxyquinaldine.

12. The low sulphur fuel of claim 8, 9, 10 or 11 wherein the fused polycyclic aromatic compound is added to the fuel in an amount in the range 50 to 2000 ppm by weight of the total fuel composition.

13. The low sulphur fuel of claim 12 wherein the base fuel is a diesel fuel.

14. The low sulphur fuel of claim 13 wherein the diesel fuel contains not more than 50 ppm by weight of sulphur.

* * * * *